US011317729B2

(12) United States Patent
Wang et al.

(10) Patent No.: US 11,317,729 B2
(45) Date of Patent: May 3, 2022

(54) ADJUSTABLE BED WITH FOLDING MECHANISM

(71) Applicant: Nisco Co., Ltd, Jiangsu (CN)

(72) Inventors: Wei Wang, Jiangsu (CN); Jian Xie, Jiangsu (CN); Yifan Mao, Jiangsu (CN); Hailong Sun, Jiangsu (CN); Jinquan Ren, Jiangsu (CN)

(73) Assignee: NISCO CO., LTD, Jiangsu (CN)

( * ) Notice: Subject to any disclaimer, the term of this patent is extended or adjusted under 35 U.S.C. 154(b) by 296 days.

(21) Appl. No.: 16/729,700

(22) Filed: Dec. 30, 2019

(65) Prior Publication Data

US 2020/0214460 A1 Jul. 9, 2020

Related U.S. Application Data

(60) Provisional application No. 62/790,583, filed on Jan. 10, 2019, provisional application No. 62/789,047, filed on Jan. 7, 2019, provisional application No. 62/789,062, filed on Jan. 7, 2019.

(51) Int. Cl.
*A47C 20/04* (2006.01)
*A47C 21/00* (2006.01)

(52) U.S. Cl.
CPC ..... *A47C 20/04* (2013.01); *A47C 21/006* (2013.01)

(58) Field of Classification Search
CPC ..... A47C 20/04; A47C 21/006
See application file for complete search history.

(56) References Cited

U.S. PATENT DOCUMENTS

| | | | | |
|---|---|---|---|---|
| 1,659,941 | A * | 2/1928 | Cable | A47C 19/122 5/310 |
| 6,035,467 | A * | 3/2000 | Lee | A47C 17/70 5/174 |
| 7,448,100 | B1 * | 11/2008 | Shih | A61G 7/015 5/600 |
| 9,009,896 | B2 * | 4/2015 | Suh | A47C 20/043 5/620 |
| 9,049,942 | B2 * | 6/2015 | Huang | A47C 20/041 |
| 10,111,530 | B1 * | 10/2018 | Kramer | F16B 12/44 |
| 10,306,994 | B2 * | 6/2019 | Barr | A47C 19/025 |
| 10,463,163 | B1 * | 11/2019 | Aramli | A47C 21/026 |
| 10,463,164 | B2 * | 11/2019 | Kramer | A47C 20/08 |
| 10,639,221 | B2 * | 5/2020 | Kramer | A61G 7/018 |
| 10,709,623 | B2 * | 7/2020 | Totemeier | A61G 7/018 |

(Continued)

*Primary Examiner* — Peter M. Cuomo
*Assistant Examiner* — Rahib T Zaman
(74) *Attorney, Agent, or Firm* — Locke Lord LLP; Tim Tingkang Xia, Esq.

(57) ABSTRACT

An adjustable bed includes: a head frame and a foot frame; a head lifting assembly including a head lifting bracket pivotally connected to the head frame, and a head lifting actuator pivotally connected between the head lifting bracket and the head frame for operably driving the head lifting bracket to pivotally move in an upward rotating direction or a downward rotating direction; a foot lifting assembly including a foot lifting bracket pivotally connected to the foot frame, and a foot lifting actuator pivotally connected between the foot lifting bracket and the foot frame for operably driving the foot lifting bracket to pivotally move in an upward rotating direction or a downward rotating direction; and a folding mechanism connecting the head frame and the foot frame such that the head frame and the foot frame are pivotably foldable to one another at the folding mechanism.

12 Claims, 8 Drawing Sheets

(56) References Cited

U.S. PATENT DOCUMENTS 10,813,466 B2 * 10/2020 Jin ..... A47C 19/122
2002/0144350 A1 * 10/2002 Shih ..... A61G 7/015 5/620
2005/0076440 A1 * 4/2005 Taguchi ..... A61G 7/015 5/618
2009/0094748 A1 * 4/2009 Long ..... A47C 20/08 5/613
2009/0178201 A1 * 7/2009 Lujan ..... A47C 20/027 5/618
2009/0211028 A1 * 8/2009 Richmond ..... A47C 20/041 5/618
2010/0299831 A1 * 12/2010 Lee ..... A47C 19/126 5/202
2012/0047650 A1 * 3/2012 Lin ..... A47C 19/122 5/400
2012/0222216 A1 * 9/2012 Jin ..... A47C 19/122 5/400
2013/0312185 A1 * 11/2013 Suh ..... A47C 20/043 5/618
2014/0250599 A1 * 9/2014 Cassell ..... A61G 7/015 5/613
2014/0250600 A1 * 9/2014 Mccarty ..... A61G 7/015 5/617
2014/0366267 A1 * 12/2014 Suh ..... A47C 19/122 5/174
2016/0262549 A1 * 9/2016 Rawls-Meehan .... A47C 20/027
2017/0119166 A1 * 5/2017 An ..... A47C 17/40
2017/0325592 A1 * 11/2017 Suh ..... A47C 20/041
2018/0110665 A1 * 4/2018 Totemeier ..... A61G 7/1096
2018/0125255 A1 * 5/2018 Jin ..... A47C 19/122
2018/0271296 A1 * 9/2018 Harrow ..... A47C 19/022
2019/0328593 A1 * 10/2019 Choi ..... A61G 7/015

* cited by examiner

ADJUSTABLE BED WITH FOLDING MECHANISM

CROSS-REFERENCE TO RELATED PATENT APPLICATIONS

This application claims priority to and the benefit of, pursuant to 35 U.S.C. § 119(e), U.S. Provisional Patent Application Ser. Nos. 62/789,062 filed Jan. 7, 2019, 62/789,047 filed Jan. 7, 2019, and 62/790,583 filed Jan. 10, 2019, which are incorporated herein in their entireties by reference.

FIELD OF THE INVENTION

The invention generally relates to a bed, and more particular to an adjustable bed with folding mechanism.

BACKGROUND OF THE INVENTION

Adjustable beds are used more and more in healthcare, home improvement scenarios. Recently, electric motors have been applied to adjustable beds to facilitate movements through different positions. For a conventional adjustable bed, when an upper portion of an adjustable bed is lifted, it may be difficult to optimize the force on the motor. It may also be difficult and cumbersome to store the adjustable bed.

Therefore, a heretofore unaddressed need exists in the art to address the aforementioned deficiencies and inadequacies.

SUMMARY OF THE INVENTION

The invention, in one aspect, relates to a folding mechanism of an adjustable bed having a power operation system with a power head lifting operation system and a power foot lifting operation system.

According to one aspect of the invention, an adjustable bed includes a head frame and a foot frame; a head lifting assembly including a head lifting bracket pivotally connected to the head frame, and a head lifting actuator pivotally connected between the head lifting bracket and the head frame for operably driving the head lifting bracket to pivotally move in an upward rotating direction or a downward rotating direction relative to the head frame; a foot lifting assembly including a foot lifting bracket pivotally connected to the foot frame, and a foot lifting actuator pivotally connected between the foot lifting bracket and the foot frame for operably driving the foot lifting bracket to pivotally move in an upward rotating direction or a downward rotating direction relative to the foot frame; and a folding mechanism connecting the head frame and the foot frame such that the head frame and the foot frame are pivotably foldable to one another at the folding mechanism.

In one embodiment, the head frame includes an upper head frame rail, a lower head frame rail, and a pair of side head frame rails; wherein the upper head frame rail and the lower head frame rail are longitudinally spaced and transversely extended, and the pair of side head frame rails is transversely spaced and longitudinally extended, and rigidly connected to the upper head frame rail and the lower head frame rail, such that the upper head frame rail and the lower head frame rail and the pair of side head frame rails are co-planar in a rectangle form.

In one embodiment, the head lifting bracket includes a middle bar and a pair of swing arms, wherein the pair of swing arms is transversely spaced and longitudinally extended, and rigidly connected to ends of the transversely extending middle bar in an H-shaped form, and each of the pair of swing arms has a first end portion and an opposite, second end portion, wherein the first end portion of each swing arm or is pivotally mounted to a respective one of the side head frame rails of the head frame through a pivot; and the head lifting actuator includes a motor member, an outer tube extending from the motor member, an activation rod received in the outer tube, engaged with the motor member and configured to be telescopically movable relative to said outer tube according to a direction of motor rotation, wherein the motor member is pivotally connected to the upper head frame rail of the head frame through a first bracket, and the activation rod has a distal end portion pivotally connected to the middle bar of the head lifting bracket through a second bracket.

Furthermore, the swing arms are in an arc-shaped design.

Additionally, the second end portion of at least one of the swing arms is equipped with a first lifting wheel and a second lifting wheel.

In one embodiment, the foot frame includes an upper foot frame rail, a lower foot frame rail, and a pair of side foot frame rails, wherein the upper foot frame rail and the lower foot frame rail are longitudinally spaced and transversely extended, and the pair of side foot frame rails is transversely spaced and longitudinally extended, and rigidly connected to the upper foot frame rail and the lower foot frame rail, such that the upper foot frame rail and the lower foot frame rail and the pair of side foot frame rails are co-planar in a rectangle form.

In one embodiment, the foot lifting bracket includes a middle bar and a pair of swing arms, wherein the pair of swing arms is transversely spaced and longitudinally extended, and rigidly connected to ends of the transversely extending middle bar in an H-shaped form, and each of the pair of swing arms has a first end portion and an opposite, second end portion, wherein the first end portion of each swing arm or is pivotally mounted to a respective one of the side foot frame rails of the foot frame through a pivot; and the foot lifting actuator includes a motor member, an outer tube extending from the motor member, an activation rod received in the outer tube, engaged with the motor member and configured to be telescopically movable relative to said outer tube according to a direction of motor rotation, wherein the motor member is pivotally connected to the upper foot frame rail of the foot frame through a first bracket, and the activation rod has a distal end portion pivotally connected to the middle bar of the foot lifting bracket through a second bracket.

Additionally, the second end portion of at least one of the swing arms is equipped with a foot lifting wheel.

In one embodiment, the adjustable bed further includes a plurality of platforms disposed on the head frame, the head lifting assembly, the foot frame and the foot lifting assembly.

Furthermore, the plurality of platforms includes a head lifting platform and an upper seat platform mounted on the head frame and hinged with the head lifting platform through hinges; and a lower seat platform mounted on the foot frame, a thigh platform, and a leg platform, the lower seat platform hinged with the thigh platform through hinges, and the thigh platform hinged with the leg platform through hinges.

In one embodiment, the foot frame further includes a foot lifting support assembly including a sliding bracket groove, a sliding bracket, a foot lifting support tube, and a stop pin; wherein the sliding bracket groove is rigidly connected to the foot frame, the sliding bracket is received in the sliding bracket groove, the foot lifting support tube has one end connected to the sliding bracket and another end fixed to the leg platform, and the stop pin is coupled to the sliding bracket to operably restrict vertical movements of the sliding bracket.

In one embodiment, the adjustable bed further includes a controller configured to control operations of the head lifting actuator and the foot lifting actuator, respectively, so as to lift individually or cooperatively the head lifting platform, the thigh platform, and the leg platform in desired positions.

In one embodiment, the adjustable bed further includes at least one massage assembly 6 for providing massage effects to a user of the bed.

The at least one massage assembly includes a massage motor, an elastic belt, a massage motor cover, a velcro loop surface, a foam house, a velcro hook surface, and a plywood decking; wherein the velcro loop surface and the massage motor cover are connected, a side of the massage motor passes through an opening of the massage motor cover, the elastic belt passes through the side of the massage motor, the velcro hook surface is fixed onto the plywood decking, the foam house is placed inside a hole of the plywood decking, the massage motor is placed inside a hole of the foam house so that the velcro loop surface and the velcro hook surface are fit together, and the massage motor is fastened onto the plywood decking.

In one embodiment, the adjustable bed further includes a plurality of slat stabilizer brackets fixed on the pair of side head frame rails.

In one embodiment, the adjustable bed further includes a plurality of nonslip rubber pads disposed on the head frame assembly and/or the foot frame.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
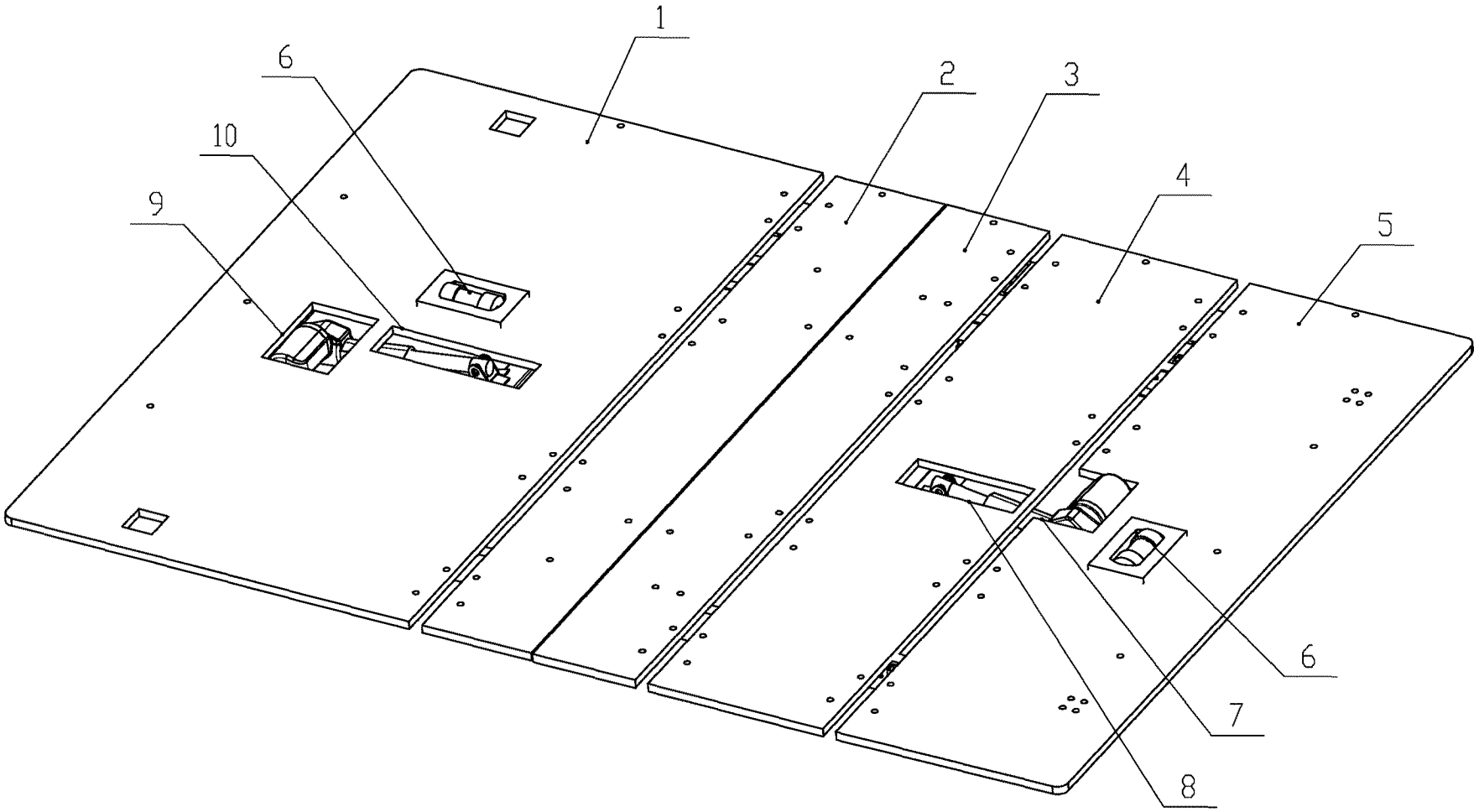
FIG. 1 shows schematically a front perspective view of an adjustable bed according to one embodiment of the invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

As used herein, "around", "about", "substantially" or "approximately" shall generally mean within 20 percent, preferably within 10 percent, and more preferably within 5 percent of a given value or range. Numerical quantities given herein are approximate, meaning that the term "around", "about" "substantially" or "approximately" can be inferred if not expressly stated.

The description will be made as to the embodiments of the invention in conjunction with the accompanying drawings in FIGS. 1-9. In accordance with the purposes of this invention, as embodied and broadly described herein, this invention, in one aspect, relates to an adjustable bed with a folding mechanism.

Referring to FIGS. 1-9, the adjustable bed is shown according to one embodiment of the invention. The adjustable bed includes a head frame 13, a foot frame 17, a head lifting assembly, a head lifting actuator, a foot lifting assembly, a foot lifting actuator, and a folding mechanism 16.

The head lifting assembly has a head lifting bracket 14 pivotally connected to the head frame 13, and a head lifting actuator pivotally connected between the head lifting bracket 14 and the head frame 13 for operably driving the head lifting bracket 14 to pivotally move in an upward rotating direction or a downward rotating direction relative to the head frame 13. The foot lifting assembly has a foot lifting bracket 19 pivotally connected to the foot frame 17, and a foot lifting actuator pivotally connected between the foot lifting bracket 19 and the foot frame 17 for operably driving the foot lifting bracket 19 to pivotally move in an upward rotating direction or a downward rotating direction relative to the foot frame 17. The folding mechanism 16 connects the head frame 13 and the foot frame 17 such that the head frame 13 and the foot frame 17 are pivotably foldable to one another at the folding mechanism 16. Preferably, the folding mechanism 16 is a hinge bracket, as shown in FIGS. 1, 4 and 7-9. Other connecting means and other types of folding mechanism can also be utilized to practice the invention.

Figure 2:
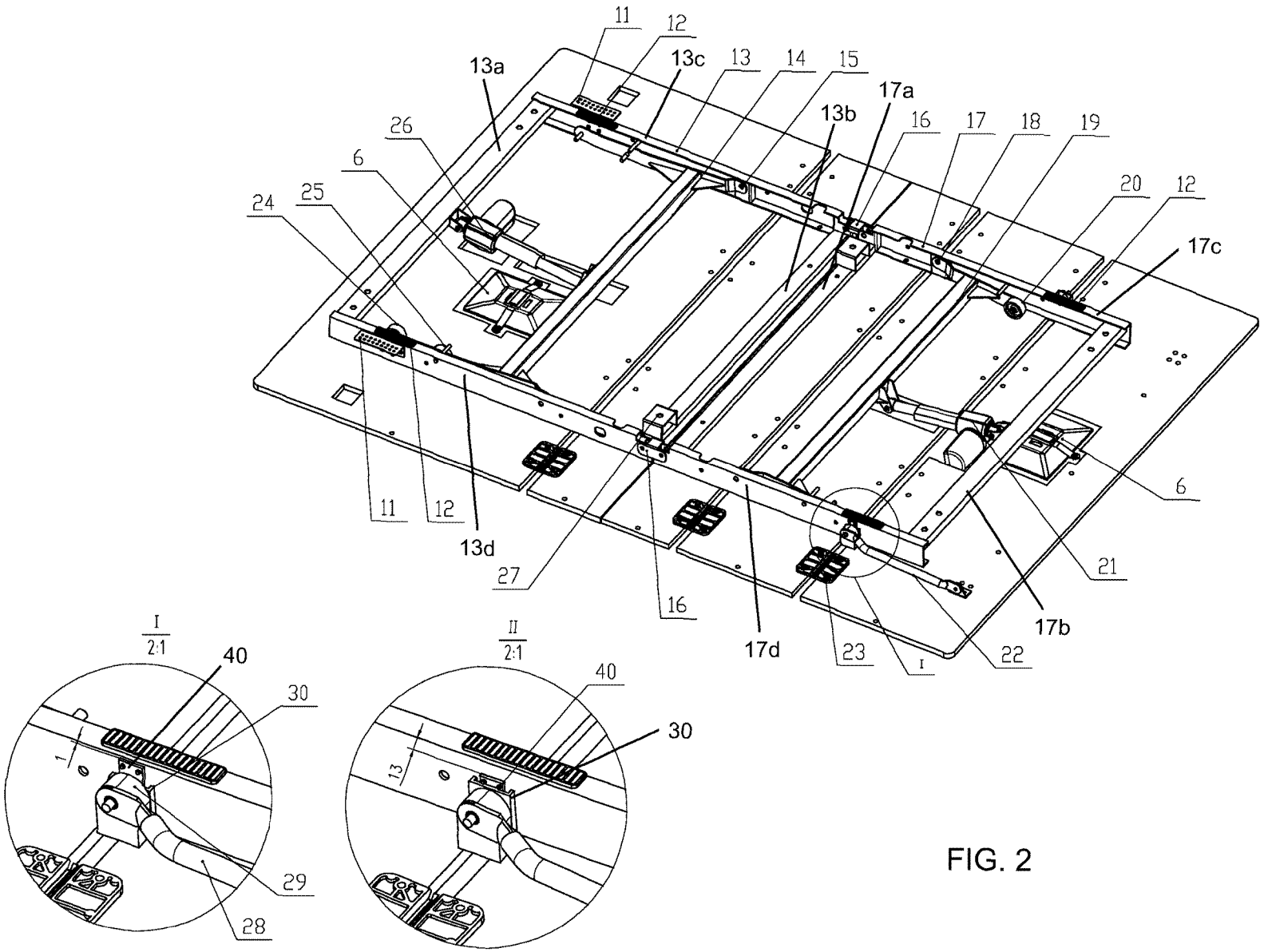
FIG. 2 shows schematically a back perspective view of a structural frame of the adjustable bed shown in FIG. 1.

As shown in FIG. 2, the head frame 13 includes an upper head frame rail 13*a*, a lower head frame rail 13*b*, and a pair of side head frame rails 13*c* and 13*d*. The upper head frame rail 13*a* and the lower head frame rail 13*b* are longitudinally spaced and transversely extended, and the pair of side head frame rails 13*c* and 13*d* is transversely spaced and longitudinally extended, and rigidly connected to the upper head frame rail 13*a* and the lower head frame rail 13*b*, such that the upper head frame rail 13*a* and the lower head frame rail 13*b* and the pair of side head frame rails 13*c* and 13*d* are co-planar in a rectangle form. Preferably, the connection of the pair of side head frame rails 13*c* and 13*d* to the upper and lower head frame rails 13*a* and 13*b* is by welding ends of the upper head frame rail 13*a* onto end portions of the pair of side head frame rails 13*c* and 13*d*, and welding ends of the lower head frame rail 13*b* onto opposite end portions of the pair of side head frame rails 13*c* and 13*d*. Other connecting means can also be utilized to practice the invention.

The head lifting bracket 14 includes a middle bar 14*a* and a pair of swing arms 14*b* and 14*c*. Each of the pair of swing arms 14*b* and 14*c* is in an arc-shaped design. The pair of swing arms 14*b* and 14*c* is transversely spaced and longitudinally extended, and rigidly connected to ends of the transversely extending middle bar 14*a* in an H-shaped form. Each of the pair of swing arms 14*b* and 14*c* has a first end portion and an opposite, second end portion. The first end portion of each swing arm 14*b* or 14*c* is pivotally mounted to a respective one of the side head frame rails 13*c* and 13*d* of the head frame 13 through a pivot 15. The second end portion of at least one of the swing arms 14*b* and 14*c* is equipped with a first lifting wheel 25 and a second lifting wheel 24. The drawings of FIGS. 2, 3 and 6-9 show only the second end portion of the swing arms 14*b* is equipped with a first lifting wheel 25 and a second lifting wheel 24. Practically, the second end portion of the swing arms 14*c* may also be equipped with the first lifting wheel 25 and the second lifting wheel 24. In addition, each of the pair of swing arms 14*b* and 14*c* may be reinforced by a pair of reinforcing pieces 14*d* (FIGS. 6-7) rigidly connected to an end portion of the middle bar 14*a* on either side.

The foot frame 17 includes an upper foot frame rail 17*a*, a lower foot frame rail 17*b*, and a pair of side foot frame rails 17*c* and 17*d*. The upper foot frame rail 17*a* and the lower foot frame rail 17*b* are longitudinally spaced and transversely extended, and the pair of side foot frame rails 17*c* and 17*d* is transversely spaced and longitudinally extended, and rigidly connected to the upper foot frame rail 17*a* and the lower foot frame rail 17*b*, such that the upper foot frame rail 17*a* and the lower foot frame rail 17*b* and the pair of side foot frame rails 17*c* and 17*d* are co-planar in a rectangle form. Preferably, the connection of the pair of side foot frame rails 17*c* and 17*d* to the upper and lower foot frame rails 17*a* and 17*b* is by welding ends of the upper foot frame rail 17*a* onto end portions of the pair of side foot frame rails 17*c* and 17*d*, and welding ends of the lower foot frame rail 17*b* onto opposite end portions of the pair of side foot frame rails 17*c* and 17*d*. Other connecting means can also be utilized to practice the invention.

Figure 8:
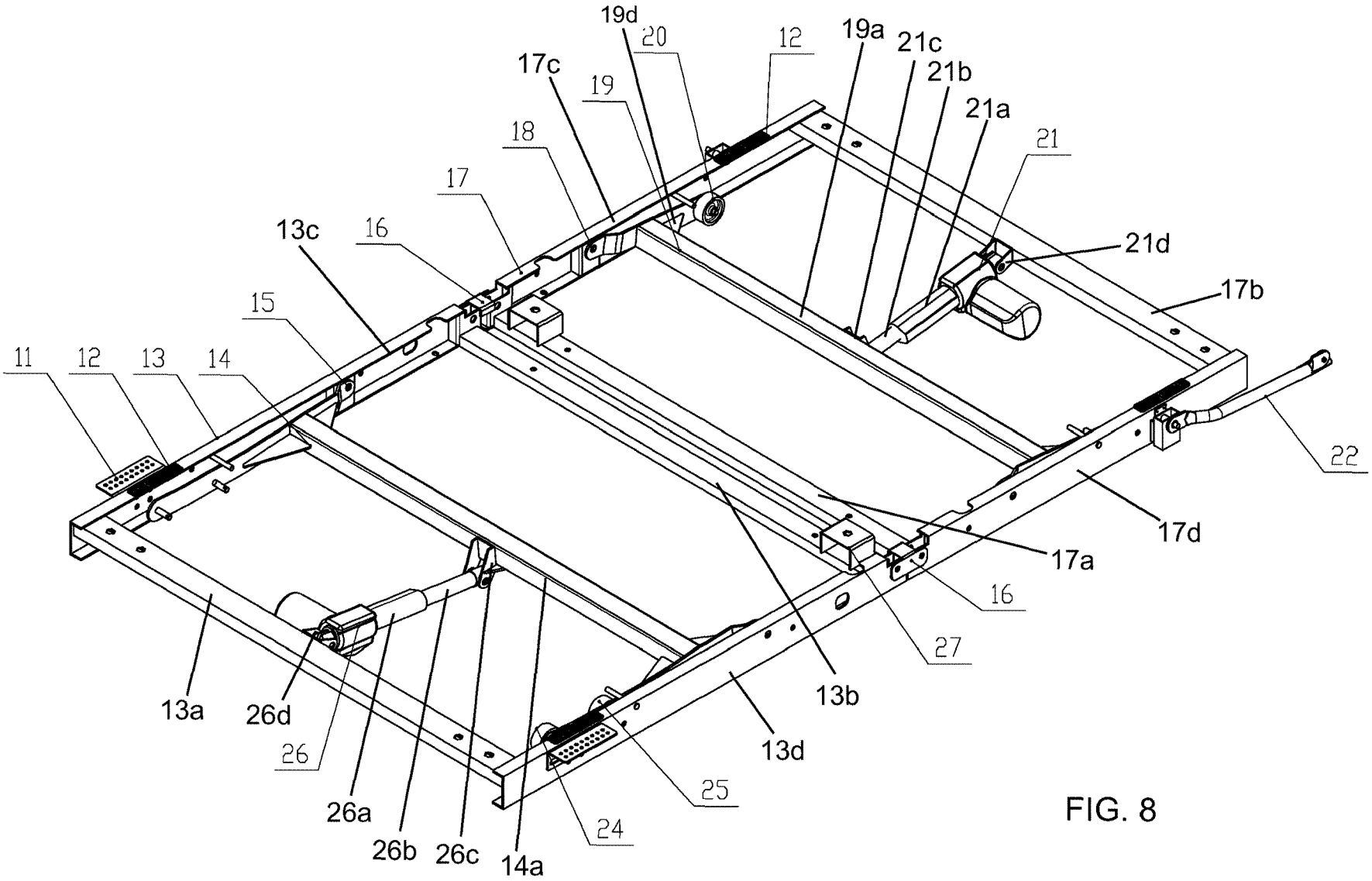
FIG. 8 shows schematically yet another back perspective view of the structural frame of the adjustable bed shown in FIG. 1.
Figure 9:
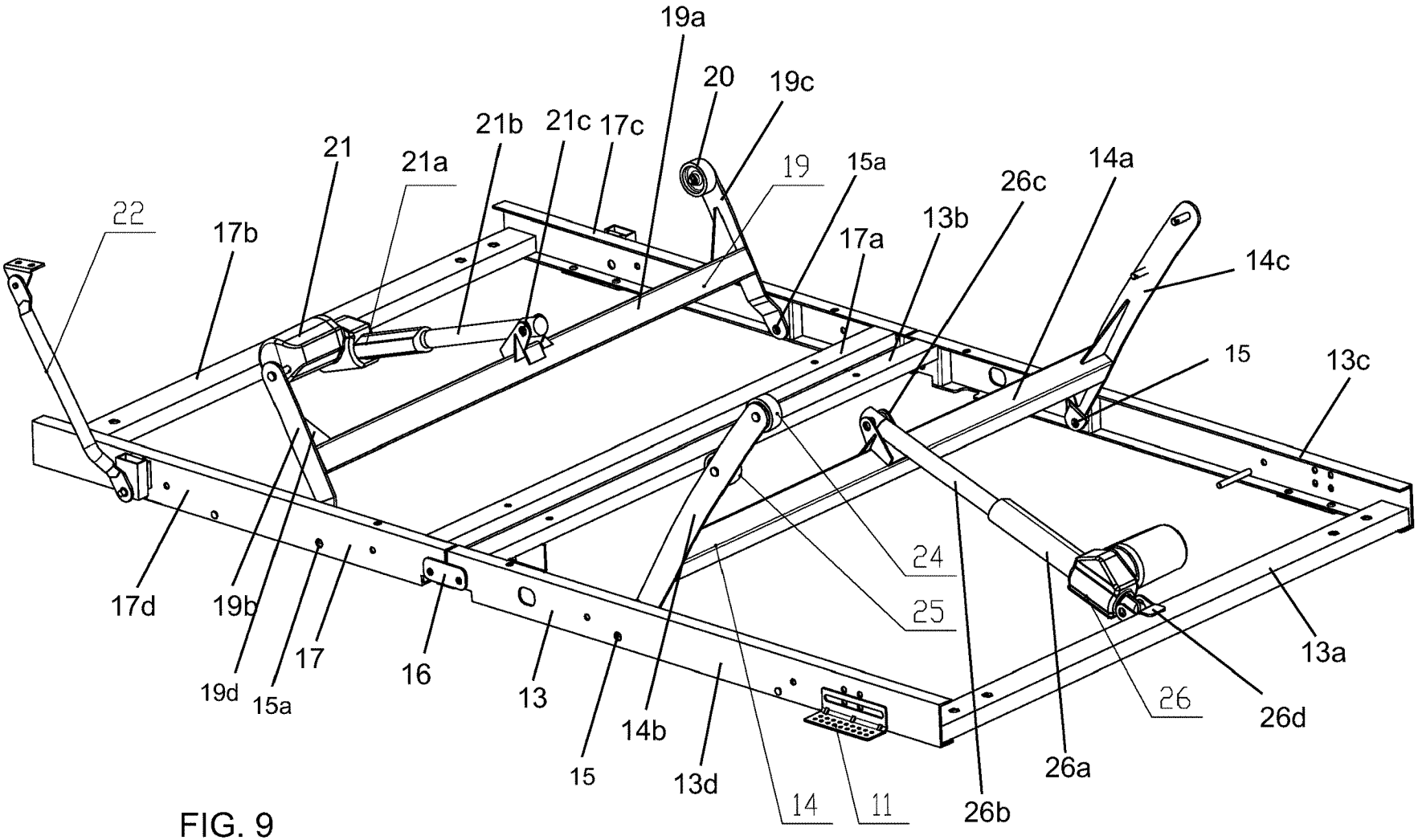
FIG. 9 shows schematically yet another front perspective view of the structural frame of the adjustable bed shown in FIG. 1.

The foot lifting bracket 19 includes a middle bar 19*a* and a pair of swing arms 19*b* and 19*c*. The pair of swing arms 19*b* and 19*c* is transversely spaced and longitudinally extended, and rigidly connected to ends of the transversely extending middle bar 19*a* in an H-shaped form. Each of the pair of swing arms 19*b* and 19*c* has a first end portion and an opposite, second end portion. The first end portion of each swing arm 19*b* or 19*c* is pivotally mounted to a respective one of the side foot frame rails 17*c* and 17*d* of the foot frame 17 through a pivot 15*a*. The second end portion of at least one of the swing arms 19*b* and 19*c* is equipped with a foot lifting wheel 20. The drawings of FIGS. 2 and 8-9 show only the second end portion of the swing arms 19*c* is equipped with the foot lifting wheel 20. Practically, the second end portion of the swing arms 19*b* may also be equipped with the foot lifting wheel 20. In addition, each of the pair of swing arms 19*b* and 19*c* may be reinforced by a reinforcing piece 19*d* (FIGS. 8-9) rigidly connected to an end portion of the middle bar 19*a* on the side not pivotally mounted through a pivot 15*a*.

As shown in FIGS. 3 and 6-9, the head lifting actuator includes a motor member 26, an outer tube 26*a* extending from the motor member 26, and an activation rod 26*b* received in the outer tube 26*a*, engaged with the motor member 26 and configured to be telescopically movable relative to said outer tube 26*a* according to a direction of motor rotation. The motor member 26 is pivotally connected to the upper head frame rail 13*a* of the head frame 13 through a first bracket 26*d*. The activation rod 26*b* has a distal end portion pivotally connected to the middle bar 14*a* of the head lifting bracket 14 through a second bracket 26*c*.

The foot lifting actuator includes a motor member 21, an outer tube 21*a* extending from the motor member 21, and an activation rod 21*b* received in the outer tube 21*a*, engaged with the motor member 21 and configured to be telescopically movable relative to said outer tube 21*a* according to a direction of motor rotation. The motor member 21 is pivotally connected to the upper foot frame rail 17*a* of the foot frame 17 through a first bracket 21*d*. The activation rod 21*b* has a distal end portion pivotally connected to the middle bar 19*a* of the foot lifting bracket 19 through a second bracket 21*c*.

The adjustable bed also includes middle leg brackets 27. One of the middle leg brackets 27 is connected to an end portion of the lower head frame rail 13*b* closer to the side head frame rail 13*d*. Another of the middle leg brackets 27 is connected to an end portion of the upper foot frame rail 17*a* closer to the side foot frame rail 17*c*.

The adjustable bed further includes a plurality of platforms disposed on the head frame 13, the head lifting assembly, the foot frame 17 and the foot lifting assembly.

The plurality of platforms includes a head lifting platform 1 and an upper seat platform 2 mounted on the head frame 13. The upper seat platform 2 is hinged with the head lifting platform 1 through hinges 23. The plurality of platforms also includes a lower seat platform 3 mounted on the foot frame 17, a thigh platform 4, and a leg platform 5. The lower seat platform 3 is hinged with the thigh platform 4 through hinges 23, and the thigh platform 4 is hinged with the leg platform 5 through hinges 23.

As shown in FIGS. 2 and 7-9, the foot frame 17 further includes at least one foot lifting support assembly 22 having a sliding bracket groove 30, a sliding bracket 29, a foot lifting support tube 28, and a stop pin 40. In some embodiments, the foot lifting support assembly 22 is attached onto each of the side foot frame rails 17*c* and 17*d* of the foot frame 17. The sliding bracket groove 30 is rigidly connected to the foot frame 17. The sliding bracket 29 has an insert piece on the side of the sliding bracket 29 that is received in the sliding bracket groove 30, the foot lifting support tube 28 has one end connected to the sliding bracket 29 and another end fixed to the leg platform 5, and the stop pin 40 is coupled to the sliding bracket 29 to operably restrict vertical movements of the sliding bracket 29. That is, the sliding bracket 29 has an insert hole on the side of the sliding bracket 29, and the stop pin 40 is inserted into the insert hole to operably restrict vertical movements of the sliding bracket 29. Under normal circumstances, a distance between the sliding bracket 29 and the foot frame 17 is 1 mm. When the foot lifting portion needs to be lifted open, the sliding bracket 29 is lifted up, for example, by 12 mm, at which time the stop pin 40 is blocked by the sliding bracket groove 30. Preferably, the sliding bracket groove 30 is welded to the foot frame 17, and the foot lifting support tube 28 is connected to the sliding bracket 29 by a bolt, but other connecting means can also be utilized.

The adjustable bed further includes a controller configured to control operations of the head lifting actuator and the foot lifting actuator, respectively, so as to lift individually or cooperatively the head lifting platform 1, the thigh platform 4, and the leg platform 5 in desired positions. A user lying on the adjustable bed can make adjustments as desired.

FIGS. 3A-3C show a sequence of the head lifting actuator operably driving the head lifting bracket 14 to pivotally move in an upward rotating direction or a downward rotating direction relative to the head frame 13. When the adjustable bed is flat, the head lifting platform 1 is in a horizontal state, the first lifting wheel 25 is in contact with the head lifting platform 1, and the second lifting wheel 24 has a gap of 10 mm from the head lifting platform 1 (as shown in FIG. 3C). When the motor member 26 drives the head lifting bracket 14 in the upward rotating direction, the first lifting wheel 25 first pushes the head lifting platform 1 to move upward. When the head lifting platform 1 reaches an angle, for example, 14°, the second lifting wheel 24 and the first lifting wheel 25 are both in contact with the head lifting platform 1 (as shown in FIG. 3B). It should be noted that the angle of 14° is an example for illustration the invention only, and other angles can also be utilized. When the motor member 26 continues to drive the head lifting bracket 14 in the upward rotating direction, the first lifting wheel 25 is disengaged from the head lifting platform 1 and is replaced by the second lifting wheel 24 to continue pushing the head lifting platform 1 to move (as shown in FIG. 3A). The above description, in reverse, also applies to the motor member 26 driving the head lifting bracket 14 in the downward rotating direction.

Figure 3:
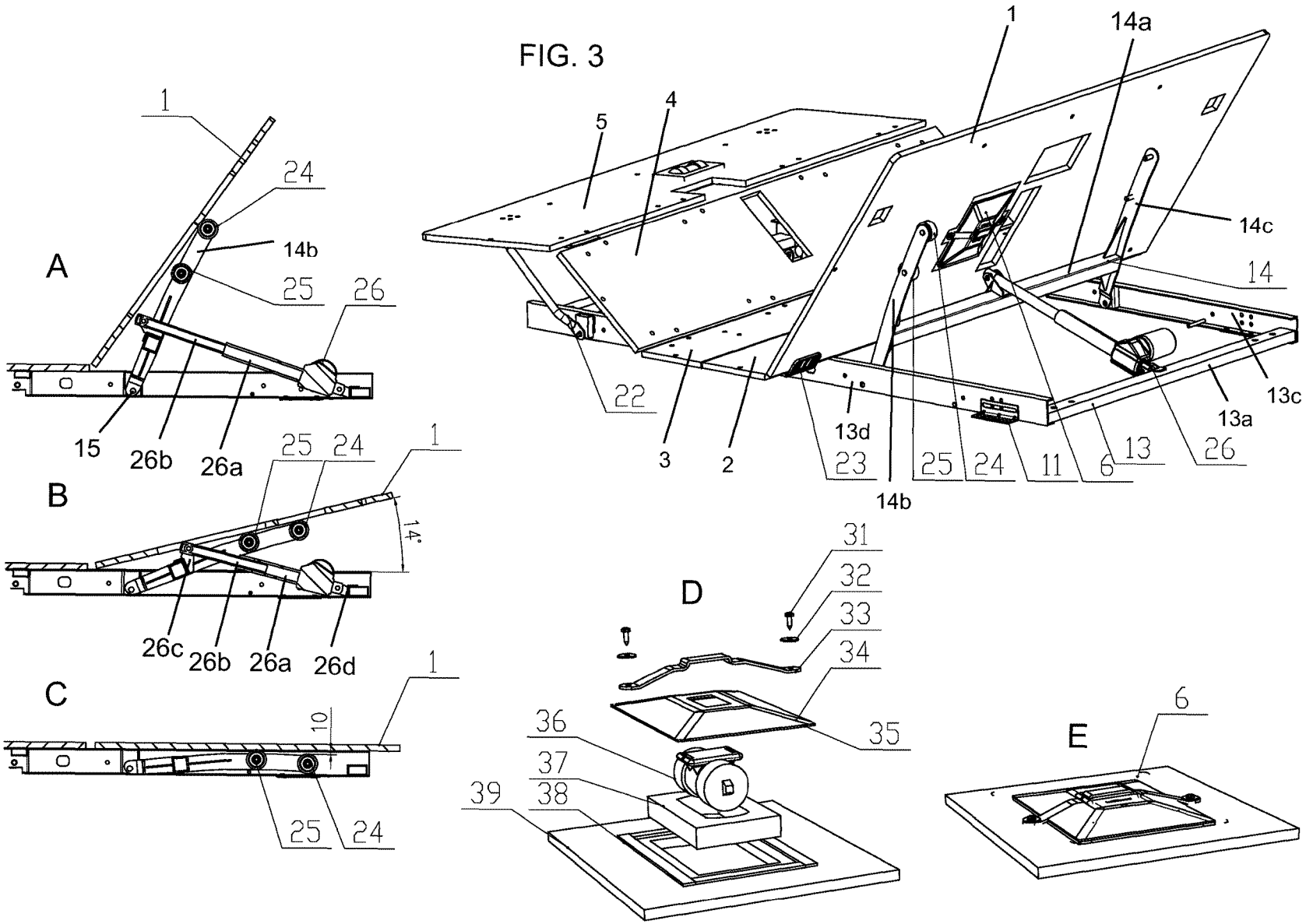
FIG. 3 shows schematically a front perspective view of a structural frame of the adjustable bed shown in FIG. 1.

As shown in FIGS. 1-3, the adjustable bed further includes at least one massage assembly 6 for providing massage effects to a user of the bed.

As shown in FIGS. 3D-3E, the at least one massage assembly 6 includes a massage motor 36, an elastic belt 33, a massage motor cover 34, a velcro loop surface 35, a foam house 37, a velcro hook surface 38, and a plywood decking 39. The velcro loop surface 35 and the massage motor cover 34 are connected. A side of the massage motor 36 passes through an opening of the massage motor cover 34, and the elastic belt 33 passes through the side of the massage motor 36 (the side of the massage motor 36 has a small opening for the elastic belt to pass through) to connect the components as a whole. Further, the velcro hook surface 38 is fixed onto the plywood decking 39 (this may be done by a nail or any other connecting means not limited thereto). The foam house 37 is placed inside a hole of the plywood decking 39, and the massage motor 36 as assembled above is placed inside a hole of the foam house 37 so that the velcro loop surface 35 and the velcro hook surface 38 are fit together. Finally, the massage motor 36 is fastened onto the plywood decking 39 (this may be done via a pair of screws 31 and a pair of washers 32, but other connecting means may also be utilized). The massage motor can be easily replaced by simply removing the elastic belt 33 from the side of the massage motor 36 and separating the velcro surfaces.

As shown in FIG. 1, the adjustable bed further includes a first opening for motor 9 in the head lifting platform 1 to accommodate the motor member 26; a second opening for motor 10 in the head lifting platform 1 to accommodate the motor member 26; a third opening for motor 7 in the leg platform 5 to accommodate the motor member 21; and a fourth opening for motor 8 in the thigh platform 4 to accommodate the motor member 21. When the adjustable bed is fully laid flat, the first opening for motor 9, the second opening for motor 10, the third opening for motor 7, and the fourth opening for motor 8 accommodate the motor member 26 and the motor member 21, therefore avoiding collision, increasing motor thrust angle and reducing the overall height of the adjustable bed, making the bed thinner.

Figure 4:
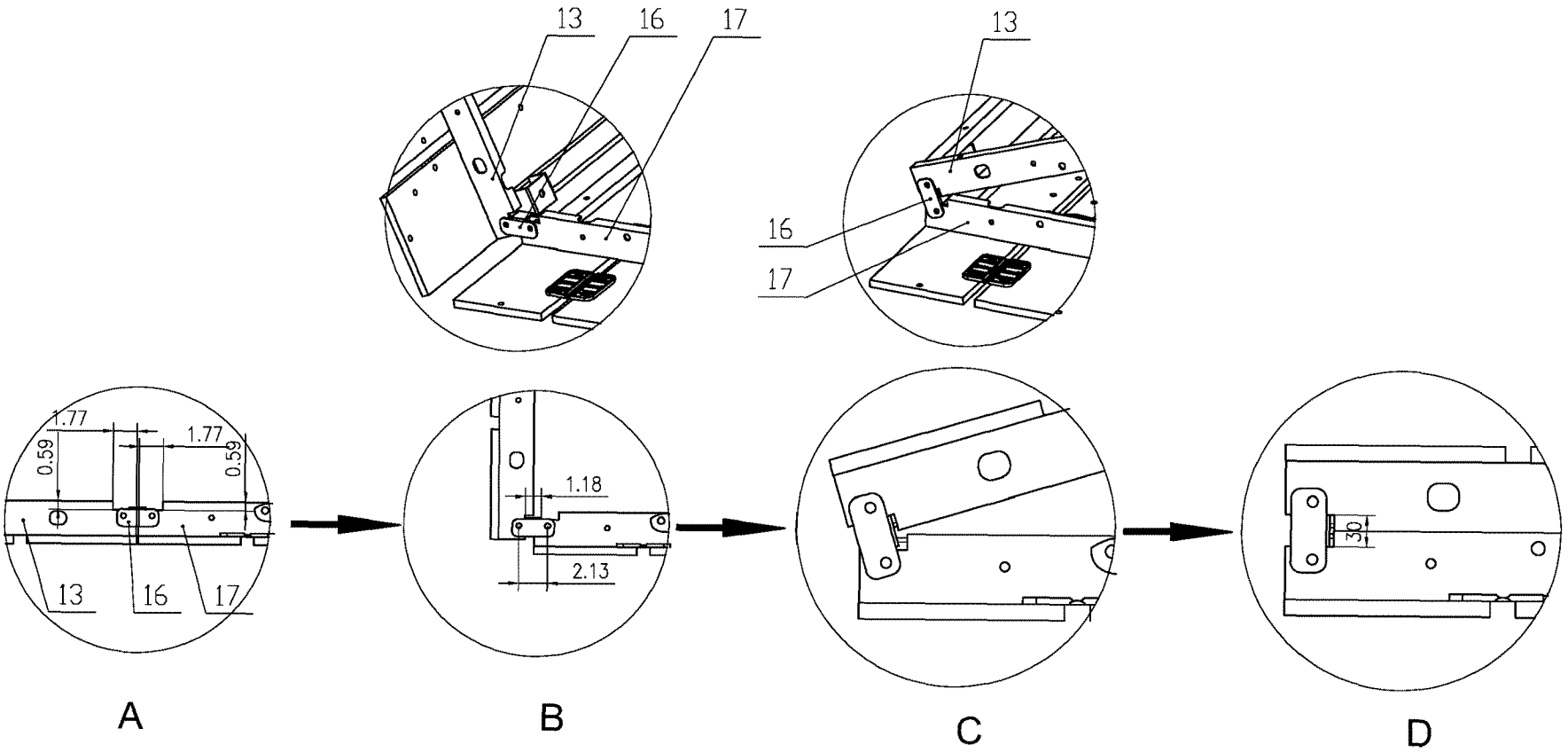
FIG. 4 shows schematically a folding sequence of the structural frame of the adjustable bed shown in FIG. 1.
Figure 5:
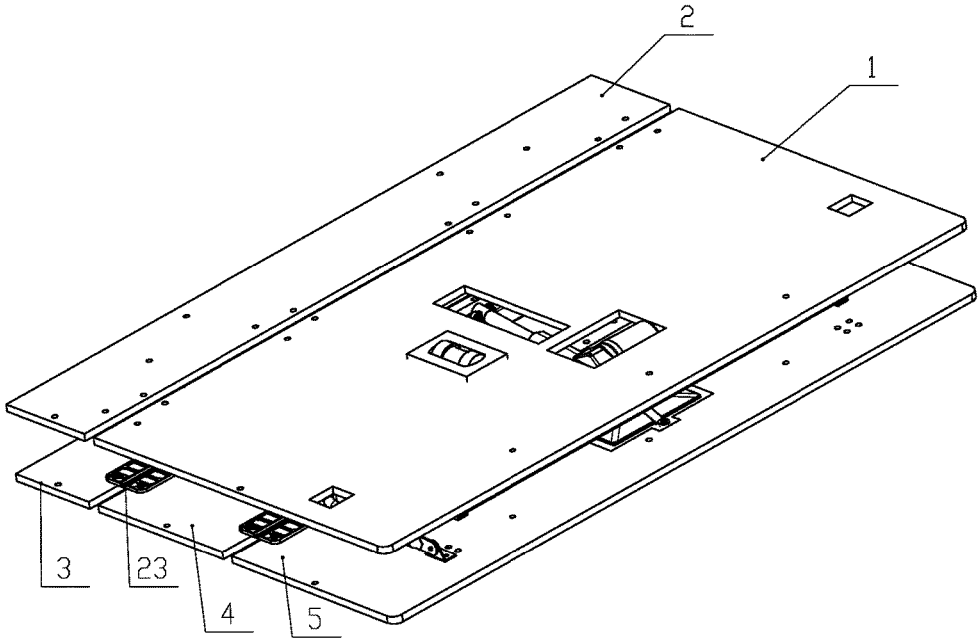
FIG. 5 shows schematically another front perspective view of the adjustable bed shown in FIG. 1 in a folded state.
Figure 6:
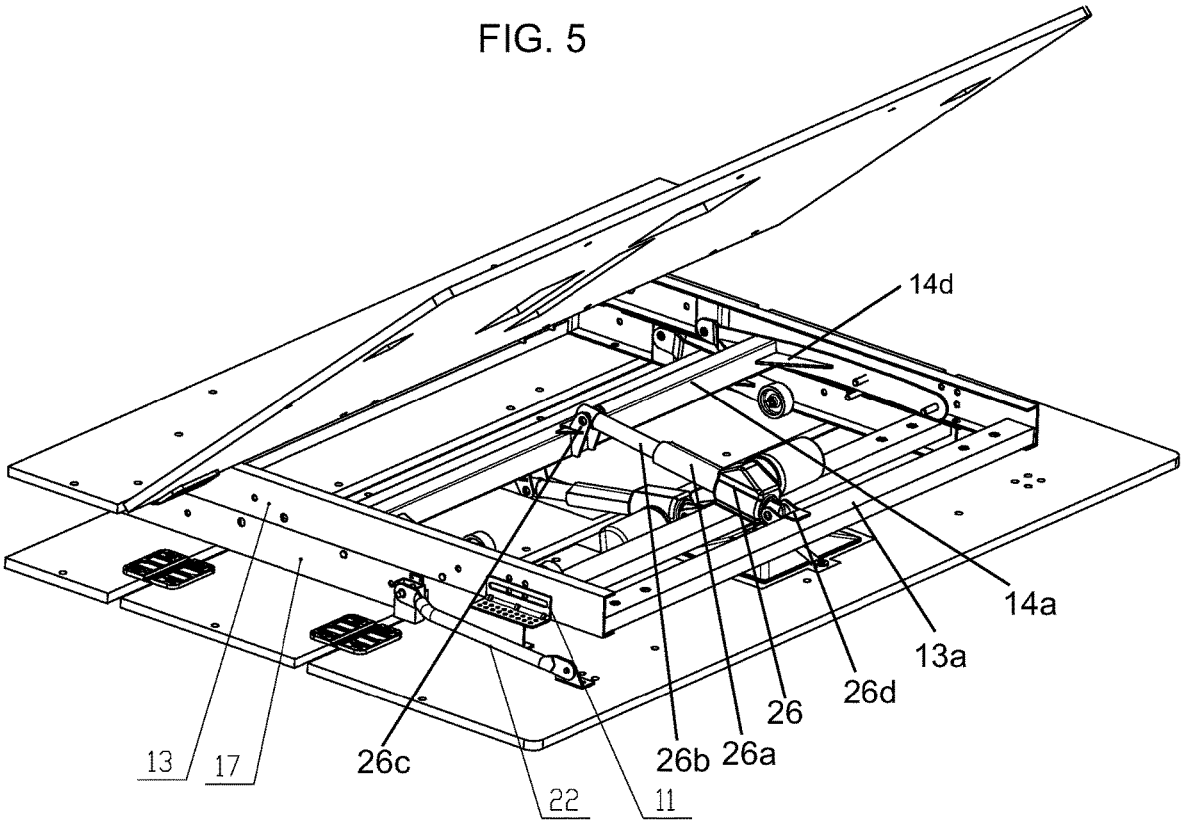
FIG. 6 shows schematically yet another front perspective view of the structural frame of the adjustable bed shown in FIG. 1 in a folded state.
Figure 7:
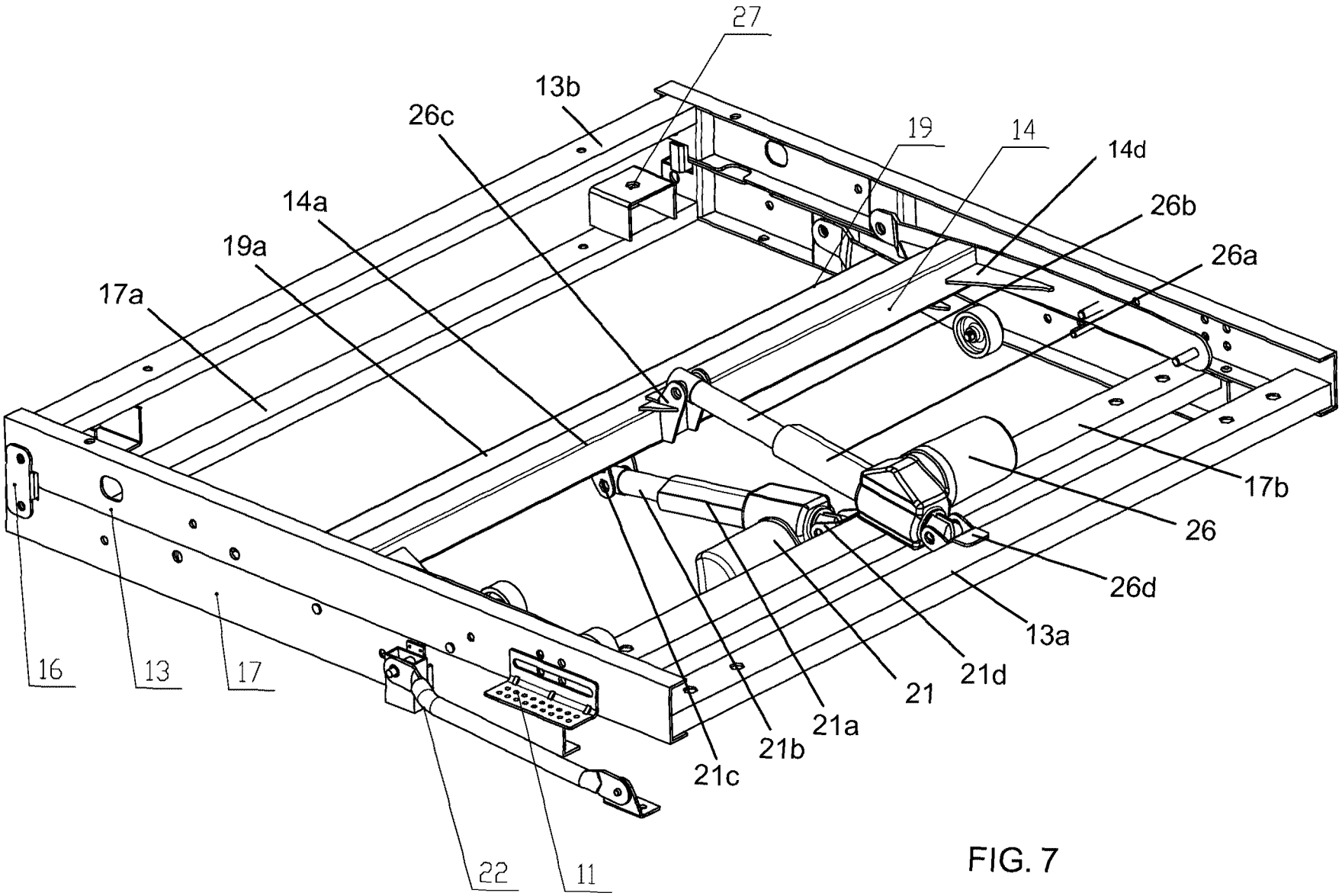
FIG. 7 shows schematically yet another front perspective view of the structural frame of the adjustable bed shown in FIG. 1 in a folded state.

A folding sequence of the adjustable bed is shown in panels A-D of FIG. 4 according to the invention. In one embodiment, the side head frame rails 13*c* and 13*d* of the head frame 13 are two pieces of U-shaped steel brackets. Each U-shaped steel bracket has an opening of, for example, but not limited to, 1.77 in ×0.59 in (as shown in panel A of FIG. 4). The same is true of the side foot frame rails 17*c* and 17*d* of the foot frame 17. The distance between the two rotation centers of the folding hinge bracket 16 is, for example, but not limited to, 2.13 in, and an upper folding edge is, for example, but not limited to, 1.18 in (as shown in panel B of FIG. 4).

When folding the adjustable bed, the head frame 13 rotates around the rotation center of the folding mechanism 16. When the side of the head frame 13 touches the upper folding edge of the folding mechanism 16 (i.e., at a 90° position, as shown in panel B of FIG. 4), the head frame 13 and the folding mechanism 16 continue to rotate around another rotation center (as shown in panel C of FIG. 4) until they overlap the foot frame 17. Alternatively, the foot frame 17 rotates around the rotation center of the folding mechanism 16. When the side of the foot frame 17 touches the upper folding edge of the folding mechanism 16, the foot frame 17 and the folding mechanism 16 continue to rotate around another rotation center until they overlap the head frame 13. The upper folding edge of the folding mechanism 16 being, for example, but not limited to, 1.18 in, limits the position during the folding process. When the adjustable bed is completely folded, there is no gap between the head frame 13 and the foot frame 17, which minimizes the folded thickness.

The adjustable bed further includes a plurality of slat stabilizer brackets 11 fixed on the pair of side head frame rails 13*c* and 13*d*.

The adjustable bed further includes a plurality of nonslip rubber pads 12 disposed on the head frame 13 and/or the foot frame 17. The nonslip rubber pads 12 are not installed with feet, and when placed on the floor, prevent the bed from shifting. The nonslip rubber pads 12 are also effective in absorbing shock when the massage motor 36 is turned on.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. An adjustable bed, comprising:

a head frame, and a foot frame;

a head lifting assembly comprising a head lifting bracket pivotally connected to the head frame, and a head lifting actuator pivotally connected between the head lifting bracket and the head frame for operably driving the head lifting bracket to pivotally move in an upward rotating direction or a downward rotating direction relative to the head frame;

a foot lifting assembly comprising a foot lifting bracket pivotally connected to the foot frame, and a foot lifting actuator pivotally connected between the foot lifting bracket and the foot frame for operably driving the foot lifting bracket to pivotally move in an upward rotating direction or a downward rotating direction relative to the foot frame;

a folding mechanism connecting the head frame and the foot frame such that the head frame and the foot frame are pivotably foldable to one another at the folding mechanism; and a plurality of platforms disposed on the head frame, the head lifting assembly, the foot frame and the foot lifting assembly, wherein the plurality of platforms comprises:

a head lifting platform and an upper seat platform mounted on the head frame and hinged with the head lifting platform through hinges; and a lower seat platform mounted on the foot frame, a thigh platform, and a leg platform, the lower seat platform hinged with the thigh platform through hinges, and the thigh platform hinged with the leg platform through hinges; wherein the foot frame comprises:

a foot lifting support assembly comprising a sliding bracket groove, a sliding bracket, a foot lifting support tube, and a stop pin;

wherein the sliding bracket groove is rigidly connected to the foot frame, the sliding bracket is received in the sliding bracket groove, the foot lifting support tube has one end connected to the sliding bracket and another end fixed to the leg platform, and the stop pin is coupled to the sliding bracket to operably restrict vertical movements of the sliding bracket.

2. The adjustable bed of claim 1, wherein the head frame comprises an upper head frame rail, a lower head frame rail, and a pair of side head frame rails; wherein the upper head frame rail and the lower head frame rail are longitudinally spaced and transversely extended, and the pair of side head frame rails is transversely spaced and longitudinally extended, and rigidly connected to the upper head frame rail and the lower head frame rail, such that the upper head frame rail and the lower head frame rail and the pair of side head frame rails are co-planar in a rectangle form.

3. The adjustable bed of claim 2, wherein the head lifting bracket comprises a middle bar and a pair of swing arms, wherein the pair of swing arms is transversely spaced and longitudinally extended, and rigidly connected to ends of the transversely extending middle bar in an H-shaped form, and each of the pair of swing arms has a first end portion and an opposite, second end portion, wherein the first end portion of each swing arm is pivotally mounted to a respective one of the side head frame rails of the head frame through a pivot; and the head lifting actuator comprises a motor member, an outer tube extending from the motor member, an activation rod received in the outer tube, engaged with the motor member and configured to be telescopically movable relative to said outer tube according to a direction of motor rotation, wherein the motor member is pivotally connected to the upper head frame rail of the head frame through a first bracket, and the activation rod has a distal end portion pivotally connected to the middle bar of the head lifting bracket through a second bracket.

4. The adjustable bed of claim 3, wherein the swing arms are in an arc-shaped design.

5. The adjustable bed of claim 3, wherein the second end portion of at least one of the swing arms is equipped with a first lifting wheel and a second lifting wheel.

6. The adjustable bed of claim 1, wherein the foot frame further comprises an upper foot frame rail, a lower foot frame rail, and a pair of side foot frame rails, wherein the upper foot frame rail and the lower foot frame rail are longitudinally spaced and transversely extended, and the pair of side foot frame rails is transversely spaced and longitudinally extended, and rigidly connected to the upper foot frame rail and the lower foot frame rail, such that the upper foot frame rail and the lower foot frame rail and the pair of side foot frame rails are co-planar in a rectangle form.

7. The adjustable bed of claim 6, wherein the foot lifting bracket comprises a middle bar and a pair of swing arms, wherein the pair of swing arms is transversely spaced and longitudinally extended, and rigidly connected to ends of the transversely extending middle bar in an H-shaped form, and each of the pair of swing arms has a first end portion and an opposite, second end portion, wherein the first end portion of each swing arm is pivotally mounted to a respective one of the side foot frame rails of the foot frame through a pivot; and the foot lifting actuator comprises a motor member, an outer tube extending from the motor member, an activation rod received in the outer tube, engaged with the motor member and configured to be telescopically movable relative to said outer tube according to a direction of motor rotation, wherein the motor member is pivotally connected to the upper foot frame rail of the foot frame through a first bracket, and the activation rod has a distal end portion pivotally connected to the middle bar of the foot lifting bracket through a second bracket.

8. The adjustable bed of claim 7, wherein the second end portion of at least one of the swing arms is equipped with a foot lifting wheel.

9. The adjustable bed of claim 1, further comprising a controller configured to control operations of the head lifting actuator and the foot lifting actuator, respectively, so as to lift individually or cooperatively the head lifting platform, the thigh platform, and the leg platform in desired positions.

10. The adjustable bed of claim 1, further comprising a plurality of slat stabilizer brackets fixed on the pair of side head frame rails.

11. The adjustable bed of claim 1, further comprising a plurality of nonslip rubber pads disposed on the head frame and/or the foot frame.

12. An adjustable bed, comprising:

a head frame, and a foot frame;

a head lifting assembly comprising a head lifting bracket pivotally connected to the head frame, and a head lifting actuator pivotally connected between the head lifting bracket and the head frame for operably driving the head lifting bracket to pivotally move in an upward rotating direction or a downward rotating direction relative to the head frame;

a foot lifting assembly comprising a foot lifting bracket pivotally connected to the foot frame, and a foot lifting actuator pivotally connected between the foot lifting bracket and the foot frame for operably driving the foot lifting bracket to pivotally move in an upward rotating direction or a downward rotating direction relative to the foot frame;

a folding mechanism connecting the head frame and the foot frame such that the head frame and the foot frame are pivotably foldable to one another at the folding mechanism; and at least one massage assembly for providing massage effects to a user of the bed, wherein at least one massage assembly comprises a massage motor, an elastic belt, a massage motor cover, a velcro loop surface, a foam house, a velcro hook surface, and a plywood decking;

wherein the velcro loop surface and the massage motor cover are connected, a side of the massage motor passes through an opening of the massage motor cover, the elastic belt passes through the side of the massage motor, the velcro hook surface is fixed onto the plywood decking, the foam house is placed inside a hole of the plywood decking, the massage motor is placed inside a hole of the foam house so that the velcro loop surface and the velcro hook surface are fit together, and the massage motor is fastened onto the plywood decking.

* * * * *